United States Patent [19]

Purchase

[11] 3,940,757

[45] Feb. 24, 1976

[54] METHOD AND APPARATUS FOR CREATING OPTICAL DISPLAYS

[75] Inventor: Francis Jack Purchase, Waterloo, Canada

[73] Assignee: Autotelic Industries, Ltd., Ft. Erie, Canada

[22] Filed: Feb. 5, 1975

[21] Appl. No.: 547,126

[52] U.S. Cl...... 340/324 M; 178/7.3 D; 250/213 A; 250/551; 315/169 TV; 340/166 EL

[51] Int. Cl.[2]..... G08B 5/36

[58] Field of Search..... 178/7.3 D, 7.5 D; 315/169 TV, 134, 154, 159; 340/324 M, 166 EL; 250/213 A, 551

[56] References Cited

UNITED STATES PATENTS

| | | | |
|---|---|---|---|
| 2,920,232 | 1/1960 | Evans | 315/169 TV |
| 2,932,770 | 4/1960 | Livingston | 340/166 EL |
| 2,954,476 | 9/1960 | Ghandhi | 250/213 A |
| 3,198,980 | 8/1965 | Martin | 250/213 A |
| 3,223,886 | 12/1965 | Glaser | 250/213 A |
| 3,334,269 | 8/1967 | Heureux | 340/324 M |
| 3,553,458 | 1/1971 | Schagen | 250/213 A |
| 3,564,136 | 2/1971 | Gilmour et al. | 178/7.3 D |
| 3,629,590 | 12/1971 | Case | 250/551 |
| 3,749,972 | 7/1973 | DeJule | 315/169 TV |
| 3,792,258 | 2/1974 | Sliker | 250/213 A |
| 3,812,486 | 5/1974 | Purchase | 315/169 TV |
| 3,881,129 | 4/1975 | Nakayama et al. | 315/169 TV |

*Primary Examiner*—David L. Trafton
*Attorney, Agent, or Firm*—John A. Young

[57] ABSTRACT

A photoconductor gas discharge display is adapted for such rapidly moving images as television pictures by means of the present invention wherein the photoconductive elements (abbreviated as PC elements) are illuminated in advance of the addressing thereof so the impedance of each element will be low at the time of addressing. Time controlled means are provided for causing rows of PC elements to be illuminated in succession and in advance of the addressing thereof. The illuminating of the rows of elements is accomplished by gas discharge chambers disposed adjacent thereto. Each PC element opposite the gas discharge chamber has a photosensitive resistor connected thereto by which voltage signals are applied to the PC element and each PC element must be in illuminated condition for the voltage signal to be effective when applied to the element. The invention functions by pre-illuminations to achieve a sufficiently low impedance level so as to be illuminated by an addressing from a voltage signal. The PC elements are illuminated in horizontal rows and are addressed in vertical rows so that the combination of an illuminated row of the PC elements and the addressing of a vertical column of the PC elements with a voltage signal specifies a respective point in the first mentioned chamber.

30 Claims, 16 Drawing Figures

OPTICAL SCANNER WITH DIFFERENTIAL RESET
FIG. 3
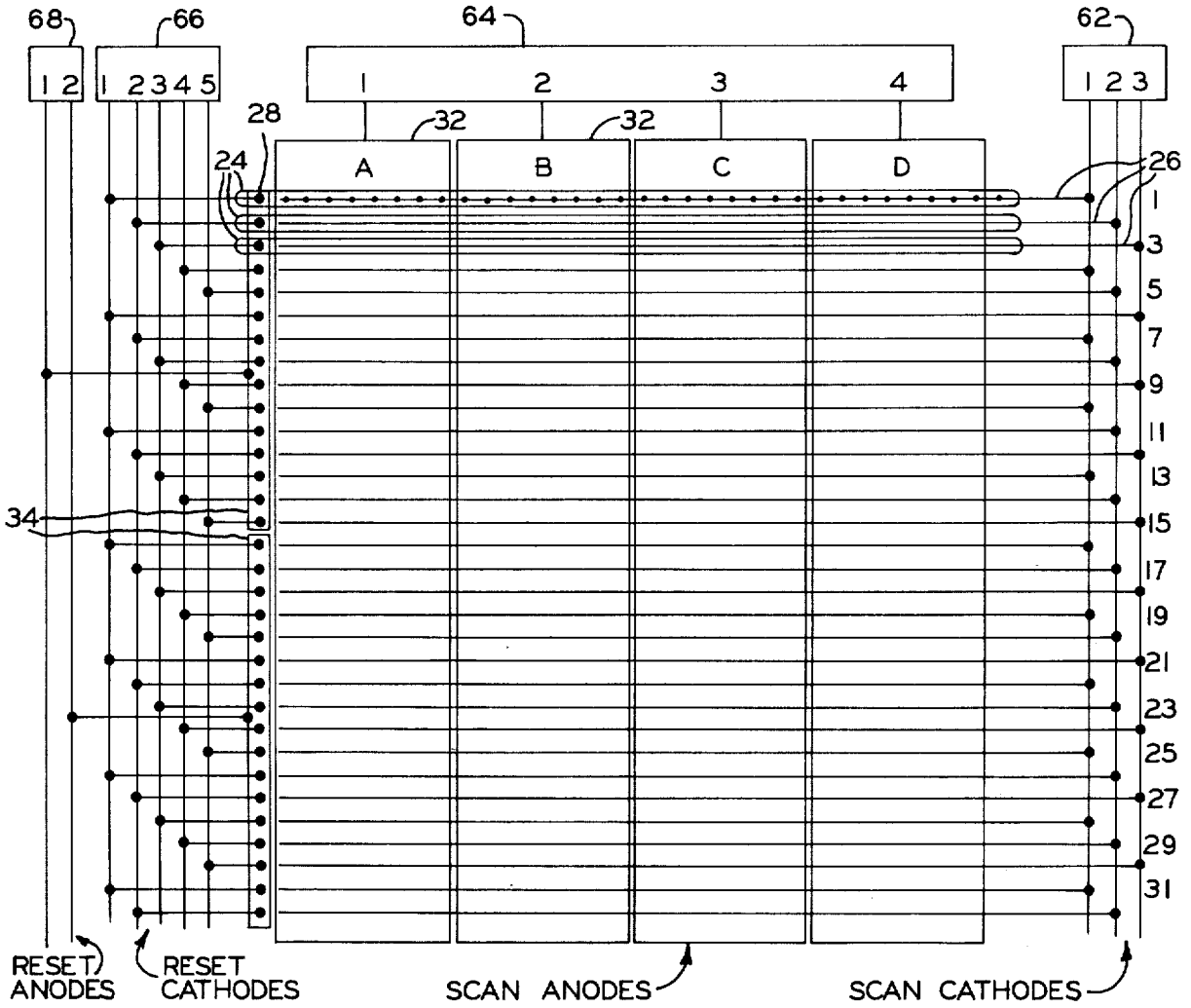
P. C. MATRIX AND GRAY SCALE SELECT
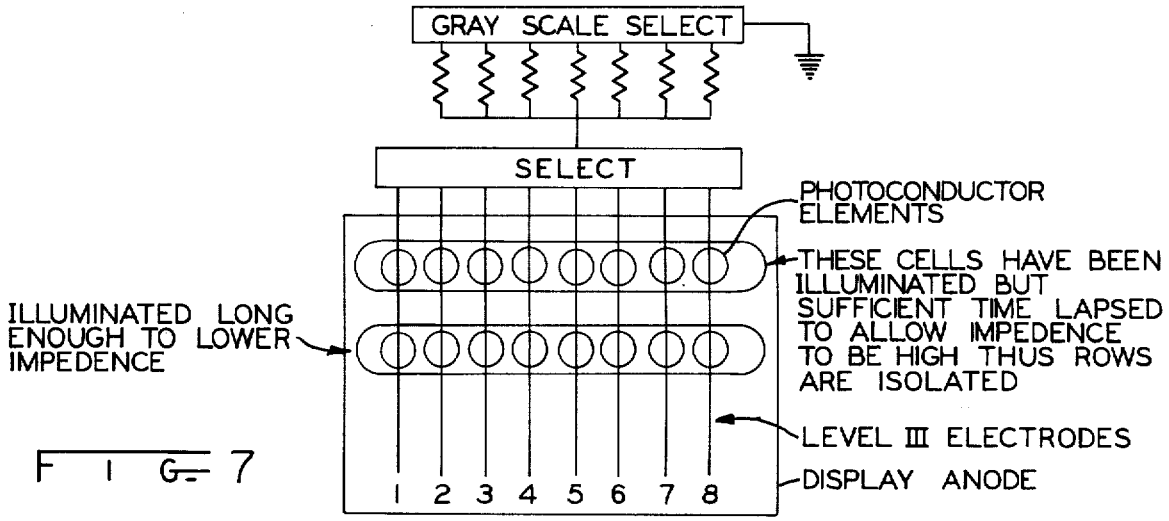
FIG. 7

DIFFERENTIAL RESET, SCAN SYSTEM

METHOD AND APPARATUS FOR CREATING OPTICAL DISPLAYS

BACKGROUND OF THE INVENTION

The present invention relates to a display device and is particularly concerned with a display device similar to that shown in my issued U.S. Pat. No. 3,812,486 but representing a substantial improvement thereover particularly in respect of greatly increasing the device's speed of response to applied signals in order that the earlier invention may be adapted for television use.

A display device of the general nature with which the present invention is concerned is illustrated and described in detail in my issued U.S. Pat. No. 3,812,486. Because the display device of the patent, however, is slow in operation it is for that reason suitable primarily for slow moving or stationary displays.

When a display is to be created which moves rapidly, as in the case of a television picture, the device of the patent is ineffective because the photoconductor lacks sufficient response time to be effective in transferring the electrical signals to the display gas discharge.

The present invention is concerned with a display device of the general type disclosed in U.S. Pat. No. 3,812,486, but basically modified so that the response of the device to applied signals is substantially increased.

The device of the present invention is adapted for displaying rapidly moving images and establishes the display with minimum structure and minimum electrical connections and circuitry external to the display device.

Still further, the present invention permits the making of a relatively thin flat display device sometimes referred to as a "flat image" picture display which can be used as a low cost television screen.

SUMMARY OF THE INVENTION

This invention has as its principal purpose the development of a television display utilizing a minimum number of conductors and which utilize the photoconductor elements generally described in my prior U.S. Pat. No. 3,822,414 issued July 2, 1974 and wherein the display elements are essentially the same construction and operation, but in this instance serve as television display elements rather than character and graphic display elements. By "minimum number of conductors," I mean and refer to those conductors which are external to the system and are connected to it.

The technical problem which I surmount by means of this invention is how to make the display sufficiently responsive in time so that it is capable of depicting rapidly moving images. Since the photoconductor response time is inherently limited, means have been improvised for directly overcoming the inherent lag time of response by the PC elements and I do this by pre-conditioning the photoconductors so that they become capable of response equal to any typical resistor-capacitor element. The technical solution to the problem is that I provide a scanner which moves across rows of the PC elements illuminating them in segments or clusters and by sweeping across the rows and indexing appropriately from row to row, I can pre-condition the PC elements by bringing them to an energy level so that if an individual PC element is electrically addressed by a gray scale electrical signal, the PC elements will be energized to make a display. The invention calls for these three groups - (1) a display, (2) a scanner, and (3) a gray scale. Although the display contains PC elements which are of the same construction and functional characteristics as in my previous patent, I can increase the apparent response time by pre-conditioning the PC elements with the scanner and in a synchronous but time lag manner, I then address the pre-conditioned PC elements with a gray scale device which electrically addresses an appropriate one of the pre-conditioned PC elements and the response is within the limits required so that the display is adapted to serve for television pictures.

As a result of this unique combination of elements, I can make it possible to secure a practical and economical flat image picture tube. In fact, the display size of a television picture can be made larger than state of the art devices now permit and without cumbersome multiplicity of conductors external to the device or requiring large cathode ray tubes which are now the limiting factor in size for most commercial television pictures.

The exact nature of the present invention and the several objects and advantages thereof will become more apparent upon reference to the following detailed specification taken in connection with the accompanying drawings.

DRAWINGS

FIG. 3 is a schematic showing the scanning panel in one form which the device can take and illustrating the arrangement of several control electrodes therein;

FIG. 5 is a graph showing the reaction time of the photoconductor elements;

FIG. 7 is a switch matrix for the gray scale for addressing the selected photoconductor elements;

Figure 10:
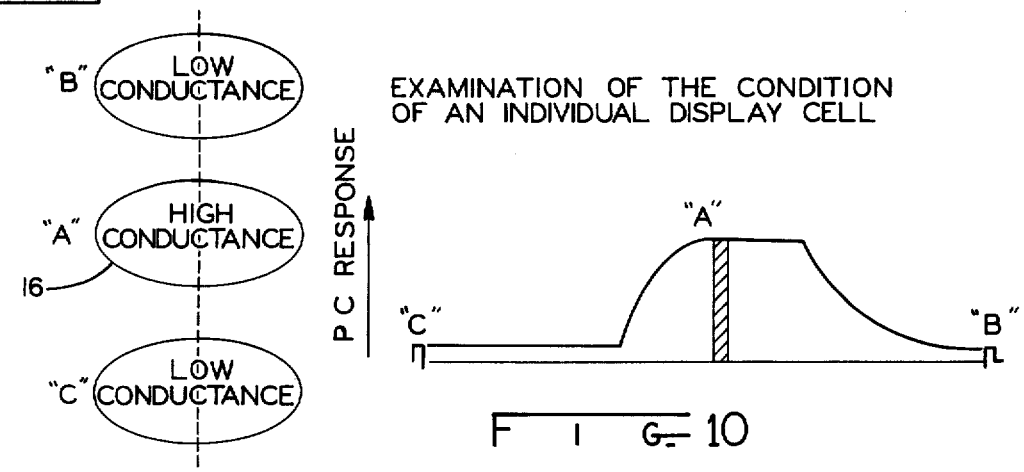

FIG. 10 is a schematic view of a single PC element showing the energy levels achieved by pre-illumination and subsequent addressing thereof by the gray scale address; and FIGS. 11A – 11F illustrate the sequential scanning which occurs by the illuminating means as it progresses in segments of eight PC elements proceeding from left to right and the indexing from one row to the next, and preparing the PC elements for their electrical addressing.

DETAILED DESCRIPTION OF THE INVENTION

Figure 1:
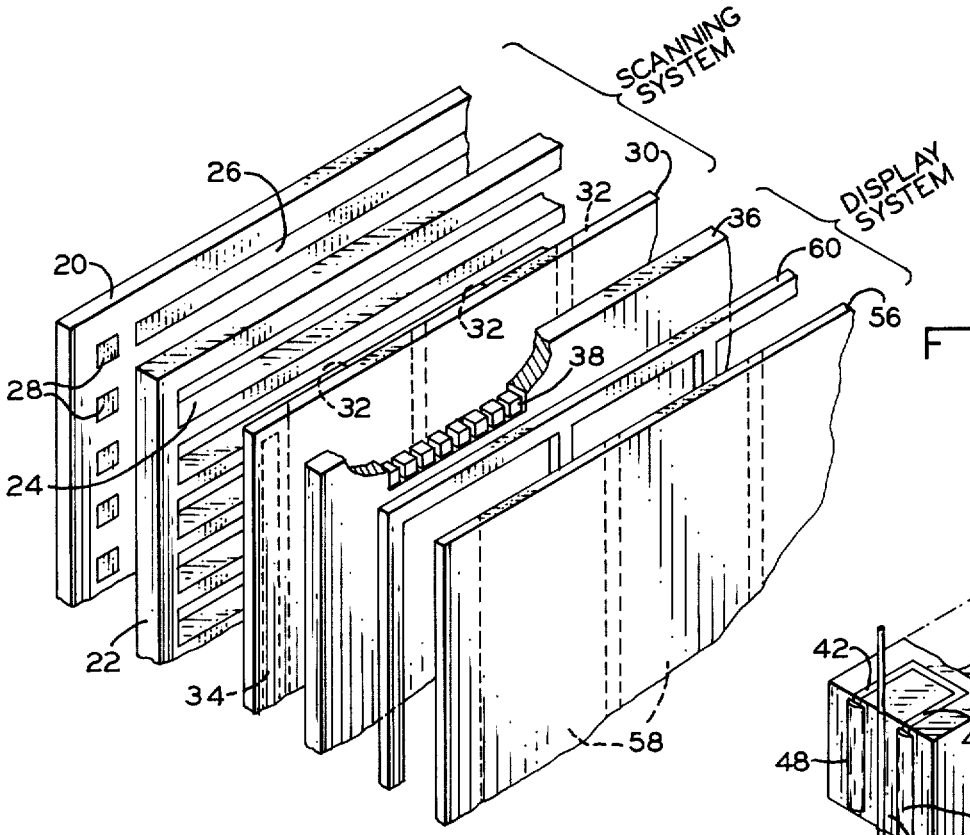
FIG. 1 is a fragmentary perspective view showing the principal parts of the display device.

Referring to the drawings more in detail, the device, as shown in FIG. 1, comprises an opaque back panel 20 which is engaged by a second panel 22 which is also preferably opaque and which may be formed of ceramic or other suitable insulating material. Panel 20 is also insulating material.

Panel 22 is provided with a plurality of gas discharge chambers 24 formed therein extending horizontally and laterally from front to back. Panel 20 carries an elongated cathode 26 which registers with each aperture 24 over the major portion of the length thereof while at one end of gas discharge chamber 24 panel 20 carries a single ionizing reset cathode 28 which is part of a switch matrix which is to be explained later and forming a part of the scanning system.

A further panel 30 engages panel 22 on the opposite side from panel 20. Panel 30 is transparent and on the side facing panel 22 is a plurality of anodes 32 thereon and which are also transparent. Anodes 32 may, for example, be in the form of tin oxide films.

Panel 30 also carries a further ionizing reset anode indicated at 34, and which is opposed to the ionizing reset cathode 28 on panel 20. A further panel 36 of opaque electrical insulating material engages panel 30 on the side opposite panel 22. Rows of photoconductive elements 38 in side by side relation are distributed in panel 36 in registration with gas discharge chamber 24.

A typical photoconductive element 38 (illustrated in FIG. 2) comprises a metallic body 40 having a recess 42 in the end facing panel 30 and within which recess 42 there is mounted a photoconductor element 44. The photoconductor element may comprise, for example, a polycrystalline material suspended in a transparent plastic in sufficient density to be in continuous phase.

The individual polycrystals may be formed of cadmium and selenium with a doping agent which may consist of copper or chlorine. A variety of compositions of the photoconductor elements can be employed and the cadmium selenide referred to will be understood to be merely an example composition.

In any case, the photoconductor element 44 is mounted in metallic body 40 with a layer of insulating material 46 interposed therebetween. The photoconductor element 44 is electrically connected to metallic body 40 by metallic films as at 48 and 50 and metallic film 52 is provided which is connected to the photoconductor element 44 in a region spaced from the aforementioned points 48 and 50. The arrangement is such that a voltage applied to film 52 will be transmitted to metal body 50 only when the photoconductor element 44 is illuminated and, thus, in a low impedance condition.

The end of metallic body 40 facing away from photoconductor element 44 is formed with a concavity 54 to enhance brightness and reduce sputter.

The panel 36 has arranged in spaced opposed relation thereto a further transparent panel 56 the inward side of which is provided with transparent electrode means, tin oxide, for example, and indicated at 58. A spacing strip 60 is provided which forms a grid and extends about the periphery of panel 36 and is disposed between panels 36 and 56 to provide for a gap therebetween.

The gas discharge chamber 24 and the gap between panels 36 and 56 is filled with a gas, such as neon, containing traces of other gases which will luminesce with the application of an electric signal.

The wires or film 52 previously referred to (FIG. 2) extend in the vertical direction at right angles to the length of chamber 24 (FIG. 1) and each wire of a group of eight wires is connected to a corresponding photoconductor element 44 in each row of the photoconductive elements 38 with a common conductor for each group in a row, the groups each consisting of groups of eight PC elements. Display anode selector 58 (FIG. 1), together with selecting a chamber 24, and a respective wire or film 52, uniquely selects a point in the display device. Thus any PC element of the display matrix 10 will be uniquely actuated if these conditions occur simultaneously:

1. The PC element is in a row addressed optically by the scanner to bring the PC element to a high conductive state (FIG. 10).

2. The same PC element is in a column addressed by the gray scale address applied on film 52 (FIG. 2) and 3. The display anode 58 (FIG. 1) is selected; or expressed in Boolean logic terms:

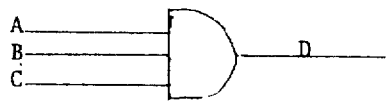

where A, B and C correspond to (1), (2) and (3) above, and D is the visible light to the observer. Quite briefly that is the scheme of the invention. Viewed still somewhat differently - this is why I call this a three level matrix address and the means by which I have achieved the unique results.

Figure 8:
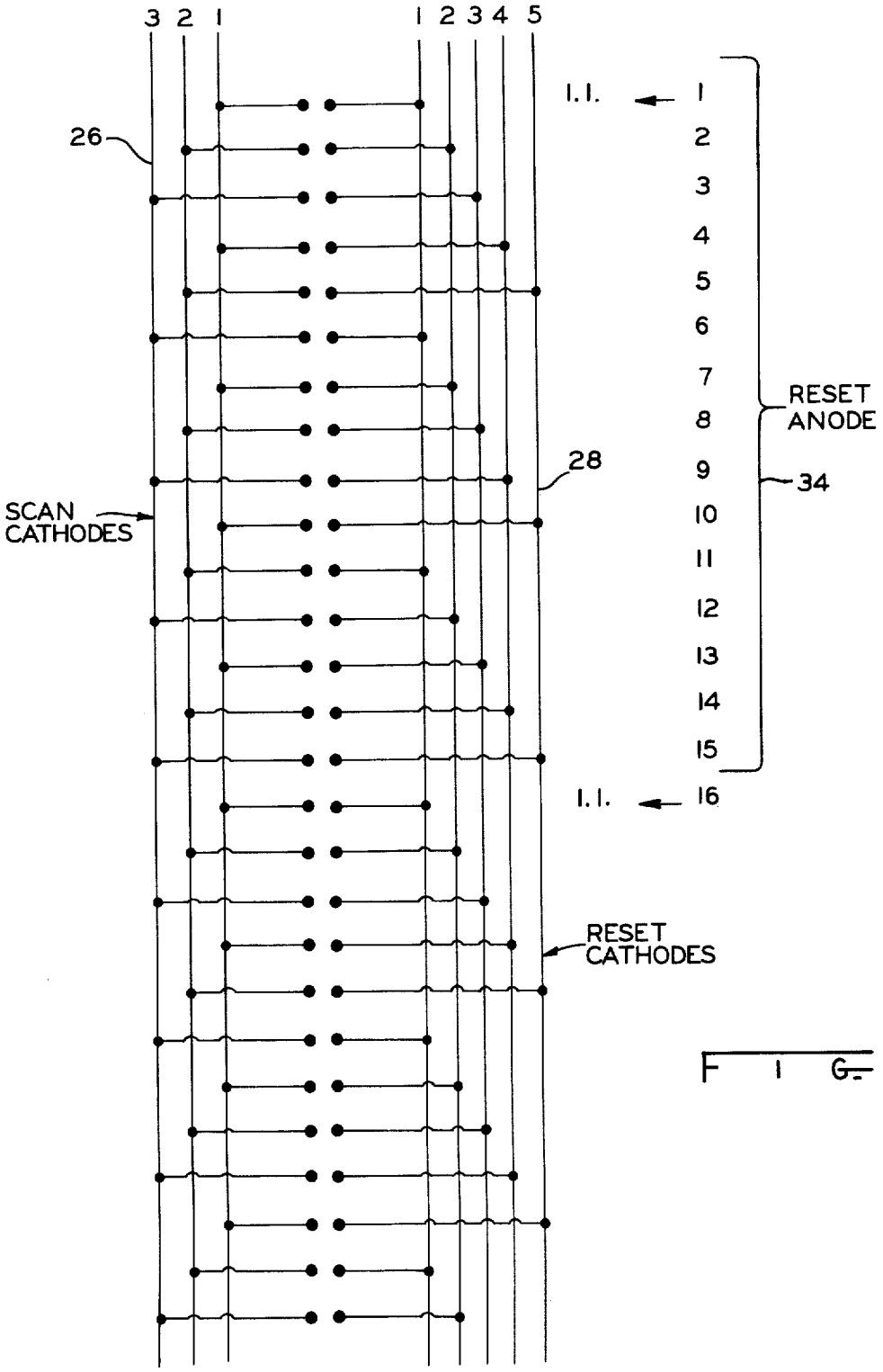
FIG. 8 is a switch matrix illustrating the differential reset scan system.

In FIGS. 3 and 8 it will be seen that the cathodes 26 (which comprise what are referred to as scan cathodes) are connected to a voltage source 62 and have a plurality of output wires, for example, three output wires; every fourth electrode is connected to a respective one of the output wires.

The electrodes 32 (which are referred to as the scan anodes), extend completely across all of the chambers 24 and, thus, across all of the cathodes 26. Each of the scan anodes 32 is connected to a source 64 having a respective output wire connected to each of the scan anodes.

The reset cathodes 28 (FIG. 8) are provided with still another source 66 which has a plurality of output wires, in this case, five output wires, and every sixth one of reset cathodes 28 is connected to a respective one of the output wires.

The electrodes 34 (referred to as the reset anodes) are elongated elements with each extending over a plurality of the reset cathodes 28 with each of the reset anodes being connected to a respective wire which wires lead to a still further voltage source 68 (FIG. 3).

The conductive elements 38 consisting of the conductive body 40 and the photoconductor element 44 mounted thereon are distributed along each chamber 24 to form a row so that, for example, eight of the members are disposed within the range of each of the scan anodes 32. It will be understood that the particular number of conductive members under each scan anode is subject to variation.

Figure 2:
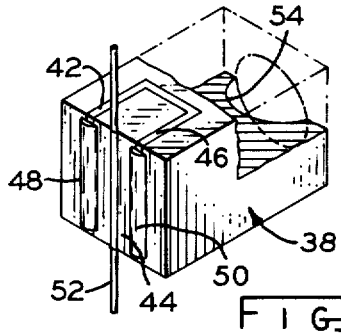
FIG. 2 is a perspective detail view showing the construction of one of the photoconductor elements of the device in FIG. 1.

The addressing wires 52 extend vertically as shown in FIG. 2 and interconnect corresponding ones of the resistance elements in each row.

The device described above will be seen to be similar to that disclosed and described in my issued U.S. Pat. No. 3,812,486 with the exception that the chambers 24 in the present arrangement are completely isolated from one another instead of being interconnected for ion exchange therebetween as in the device of the patent referred to.

The reason for this difference is that the previous device was adapted for making stationary or slow moving displays whereas the device of the present invention is adapted for use in creating rapidly moving displays as for television purposes and the like.

Figures 4, 5:
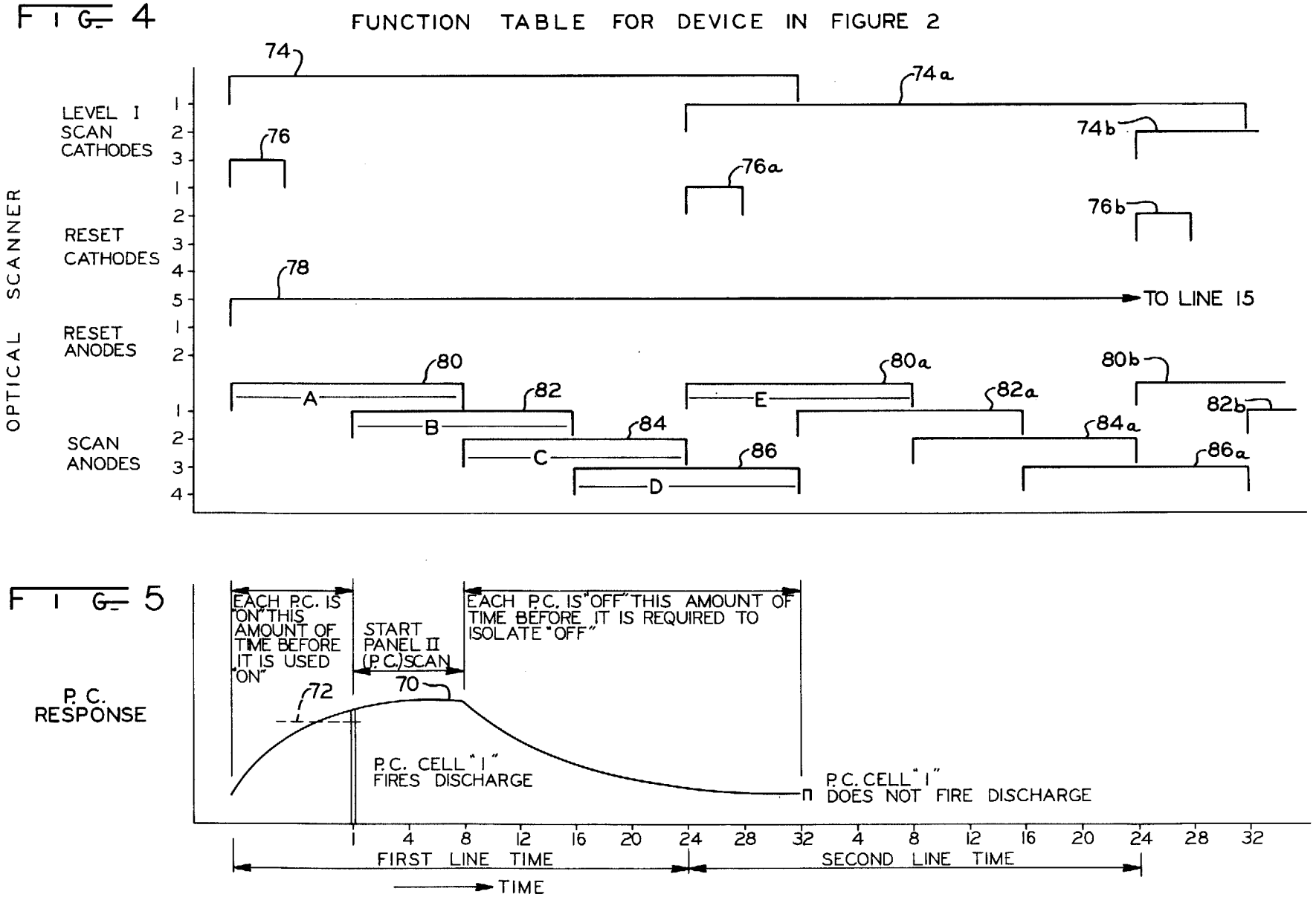
FIGS. 4 and 5 are a combined graph illustrating (a) the timed relationship of energization of certain of the electrodes forming a part of the device, and (b) using the same time intervals as FIG. 4.

The arrangement of the device to adapt it to the creation of rapidly moving displays such as used in television comes about on account of the characteristics of the photoconductive elements and which are shown in FIG. 5. FIG. 5 shows a graph line 70 which represents the conductivity of the photoconductive element 44. Starting at the left side of FIG. 5, the conductivity of the element 44 is quite low and if illumination is initiated at that point, the conductivity of the element gradually rises and becomes useful for conducting current at about the point marked by dashed line 72.

Figure 9:
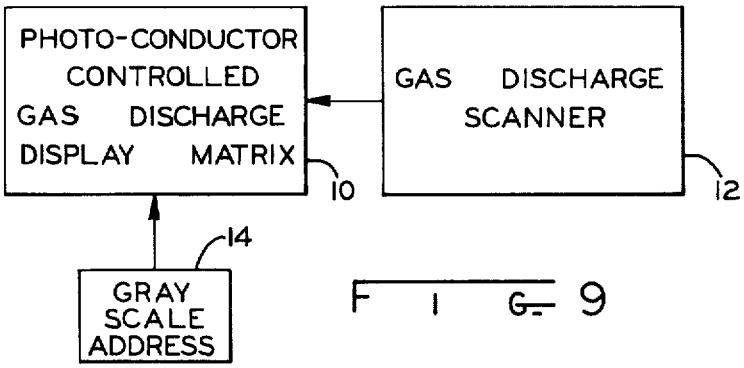
FIG. 9 is a schematic diagram of the display, scanner and gray scale address.

When the conductivity of the element rises to line 72 or somewhat beyond that point, the addressing of the resistance material by the application of a voltage pulse to a wire 52 (FIG. 2) associated with the gray scale address 14 (FIG. 9) will result in comparatively instantaneous transmission of the voltage to the opposite end of the respective photoconductive element 38 and the creation of an optical display in the chamber at that end of the conductive member, these elements 38 forming part of the display system (FIG. 1).

Since the addressing of individual pulses to each photoconductive element 38 for television purposes must take place in the range of from about 1 to 2 microseconds, it will be apparent that the rise time of the conductivity of the photoconductive elements 44, which is on the order of about 30 microseconds, is in excess of what is tolerable. Thus, according to the present invention, an arrangement is provided whereby each photoconductive element 44 (FIG. 10) is illuminated for a sufficient length of time from scanner 12 (FIG. 9) prior to the supply of the appropriate signal thereto, in the form of a voltage pulse, from the gray scale address 14 so as to increase the conductivity of the element 44 to a predetermined level when it can be comparatively instantaneously energized.

This is accomplished according to the present invention by energizing the electrodes according to the charts illustrated in FIG. 4. FIG. 4, at the top, has a line 74 representing the period of energization of a respective scan cathode 26. Therebeneath is a line 76 representing the period of energization of the respective reset cathode 28 and which is in the same chamber 24. Next beneath line 76 is a line 78 which represents the period of energization of the reset anode 34 pertaining to the energized reset cathode.

Next beneath line 78 is a group of lines 80, 82, 84 and 86 and which represent periods of energization of the respective scan anodes 32 (FIG. 3). The timed period of energization of each scan anode overlaps in time about one-half the period of energization of a respective adjacent scan.

Toward the right side of FIG. 4, line 74*a* represents the period of energization of the scan cathode next beneath the one pertaining to line 74 and line 76*a* pertains to the reset cathode next below the one pertaining to line 76. The line 78 pertaining to reset anodes 34 continues down through the fifteenth one of the scan cathodes to be energized according to the arrangement of FIG. 3 and then the second one of the reset anodes is energized. This dividing of the reset anodes into parts permits the group of the scan cathodes as illustrated without it occurring that two of the chambers 24 in spaced relation will be ionized at the same time.

The lines 80*a*, 82*a*, 84*a* and 86*a* pertain to the periods of energization of the scan anodes during the period that the scan cathode pertaining to wire 74*a* is energized.

From the chart of FIG. 4 and the circuit diagram of FIG. 8, it will be seen that the reset cathodes and reset anodes are successively energized moving in one direction across the device, namely, in the downward direction while the scan cathodes 26 are energized at the same time moving downwardly across the display device but that the energization of the scan cathodes groups will result in only a single chamber 24 becoming ionized and becoming luminescent at any one time.

In Boolean logic terms a group of PC elements are uniquely determined by the scanner function which comprises a four input AND gate where A is the reset anode, B is the reset cathode, C is the scan cathode and D is the scan anode, A+B+C+D=E where E is light emission from the segment of the scanner.

It will also be seen that the scan anodes 32 in groups are energized in succession moving in one direction across the device, namely, toward the right during each interval that a scan cathode is energized and then to a next lower row as successively shown in FIGS. 11A – 11F.

Thus, when a reset anode 34 and a respective reset cathode are energized and ions are developed in the chamber pertaining to the reset cathode, and the scan cathode in the chamber is energized, successive energization of the scan anodes 32 will result in the establishing of regions of luminescence along the respective chamber 24 moving from left to right.

During the final portion of the period of energization of each of the scan anodes, the photoconductive elements 38 distributed therealong are successively addressed by the application of voltage pulses to the respective photoconductive elements connected thereto. Inasmuch as the chamber adjacent the respective groups of conductive members are in a luminescent condition for a period of about 30 microseconds prior to the addressing of the respective elements, the supply of a voltage pulse to the photoconductive element will result in comparatively instantaneous development of a condition of luminescence between the opposite end of the respective photoconductive element and the pertaining one of the display anodes 58.

Once the addressing of the photoconductive elements 38 in the row pertaining to a respective chamber 24 commences, the elements are all addressed successively and then the wires leading from the elements are then addressed in order, but this time the next adjacent chamber 24 is in a luminescent condition so that signals will be developed at the opposite ends of the next row of conductive members. In this manner, each row of conductive members is addressed in succession moving from one side to the other and moving downwardly from the top of the display device to the bottom and then the addressing of the device commencing with the upper lefthand corner can then again commence.

This is the manner in which a television screen establishes the display thereon and the device of the present invention is adapted for this purpose due to the fact that the arrangement provides for the pre-illumination of each of the photoconductive elements sufficiently in advance of the addressing thereof that the display created by a voltage pulse appears at the end of the photoconductive element 38 pertaining thereto and facing panel 56 substantially instantaneously with the application of voltage pulse.

Figure 6:
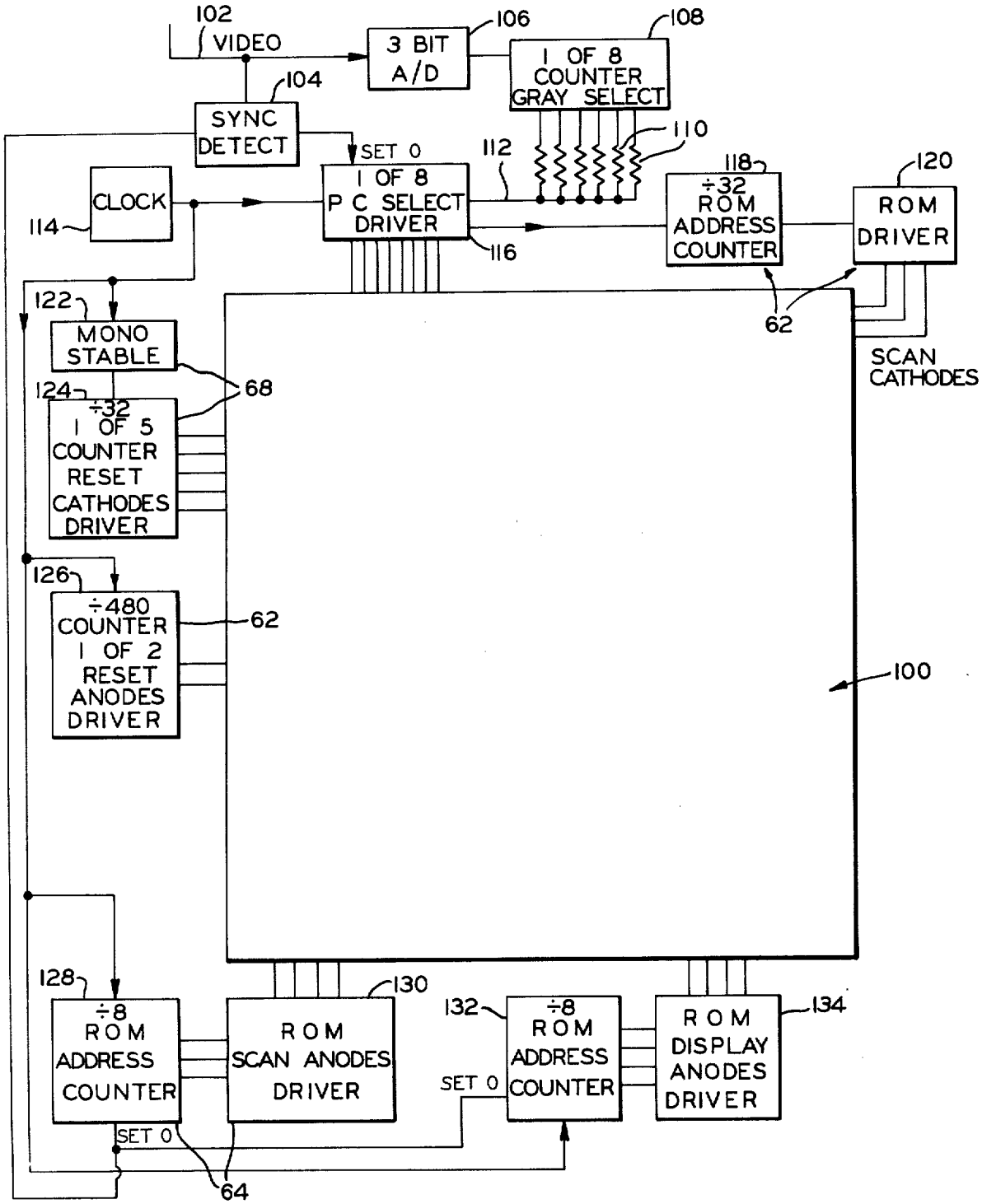
FIG. 6 is a schematic view showing how the device of the present invention can be connected for receiving a television video signal for display of the video information thereon.

FIG. 6 schematically illustrates one way in which the device of the present invention could be connected to receive a video signal. In FIG. 6, the display device of the present invention is generally indicated at 100, and it will be understood that the scan cathodes extend horizontally in respective chambers and that the conductive members 38 are addressed by wires extending vertically along the device. Also see FIG. 7.

The television video signal comes in on a wire 102 and this wire is connected to a sync detector 104.

The video signal is also supplied to a three bit analog digital converter 106 which, in turn, controls a selector 108. The selector 108 controls a group of resistors 110 and connects the resistors either singly or in various combinations to wire 112 which supplies the energy to the addressing wires 52 that have previously been referred to as being connected to the columns of photoconductive elements. The resistors 110 control the size of the energy supplied to each wire 52 and in this manner controlling the intensity of the display at the display end of the respective photoconductive element.

It has been mentioned that the chambers 24 are confronted by a plurality of scan anodes which are successively addressed as shown in the graph of FIG. 4. A comparison of FIG. 4 with FIG. 5 using the same time scale, will show that the peak of conductivity of each of the photoconductive elements 38 occurs during the period that the adjacent scan anode is energized and falls off rapidly thereafter.

Thus, it is not necessary for the wires 52 each to be independent of all the others but, instead, every ninth one of the wires 52 can be interconnected so that only eight addressing wires are required to address all of the photoconductive elements in each of the rows and with each wire extending completely across the display device in the vertical direction, only eight wires are required for addressing all of the photoconductive elements.

With the foregoing in mind, FIG. 6 includes a clock 114 which drives one-of-eight selectors 116 the output wires of which are connected to the eight addressing wires 52 previously referred to. The one-of-eight select driver 116 is also under the control of sync detector 104 which sets the driver back to zero on each sync pulse. With the described arrangement, a row of the photoconductive elements 38 will be addressed in succession and at the end of each line the select driver will be set back to zero so as to commence with the first element in the next row.

The one-of-eight selector 116 also drives a ROM address counter 118 which addresses a read only memory driver 120 which successively energizes the three wires leading from the source previously identified by reference numeral 62 in FIG. 3.

Clock 114 also drives a monostable vibrator 122 which, in turn, drives a one-of-five counter 124 having five outputs which are connected to form the five wires for energizing reset cathodes 28 and previously described as being taken from source 66 in FIG. 3.

The clock 114 also drives a one-of-two counter 126, the two outputs of which represents the outputs from source 68 in FIG. 3 and which are connected to reset anodes.

Clock 114 also drives a ROM address counter which addresses a ROM scan anode driver 130 having four output wires connected to scan anodes 32 with the four wires representing the output from source 64 referred to in FIG. 3.

Finally, clock 114 drives a read only memory address counter 132 which controls a read only memory anode driver 134 having four wires connected to respective ones of the display anodes 58 illustrated in FIG. 1 and of which there are advantageously four distributed across the device in the same manner as the scan anodes.

It will be understood that the particular display device illustrated has a relatively small number of chambers 24 therein and a relatively small number of conductive members 38 distributed along each of the said chambers. However, displays far beyond state of the art are achievable. Further, the photoconductive elements 38 can be quite small and, thus, can provide for the greater detail in the display as might be desired. The chambers 24 similarly can be small, and in this manner, the rows of conductive members can be closely adjacent each other and further increase the degree of detail that can be shown in the display.

In particular, as mentioned, the arrangement provides for pre-illumination of the photoconductive elements so that the created display occurs relatively instantaneously with the application of a voltage pulse intended to create the display. This speed of response makes a device suitable for television display purposes.

No high voltages are encountered so that there are no problems of installation and safety of operation.

SUMMARY

This device consists of three essential subassemblies of parts, the first being (FIG. 9) a photoconductor controlled gas discharge display matrix 10 which is responsive to a gas discharge scanner 12 and a gray scale address 14. The point of the entire invention is that any given PC element 16 (FIG. 10) shall be energized and in isolated relation to all other PC elements. This is accomplished by first bringing a given PC element from a low conductance condition C (FIG. 10) to a high conductance condition A by illuminating the photoconductor element by the gas discharge scanner 12 and while in this condition addressing it by the gray scale address 14 in which case the photoconductor element 16 will be energized and uniquely so in relation to all other PC elements.

Figure 11:
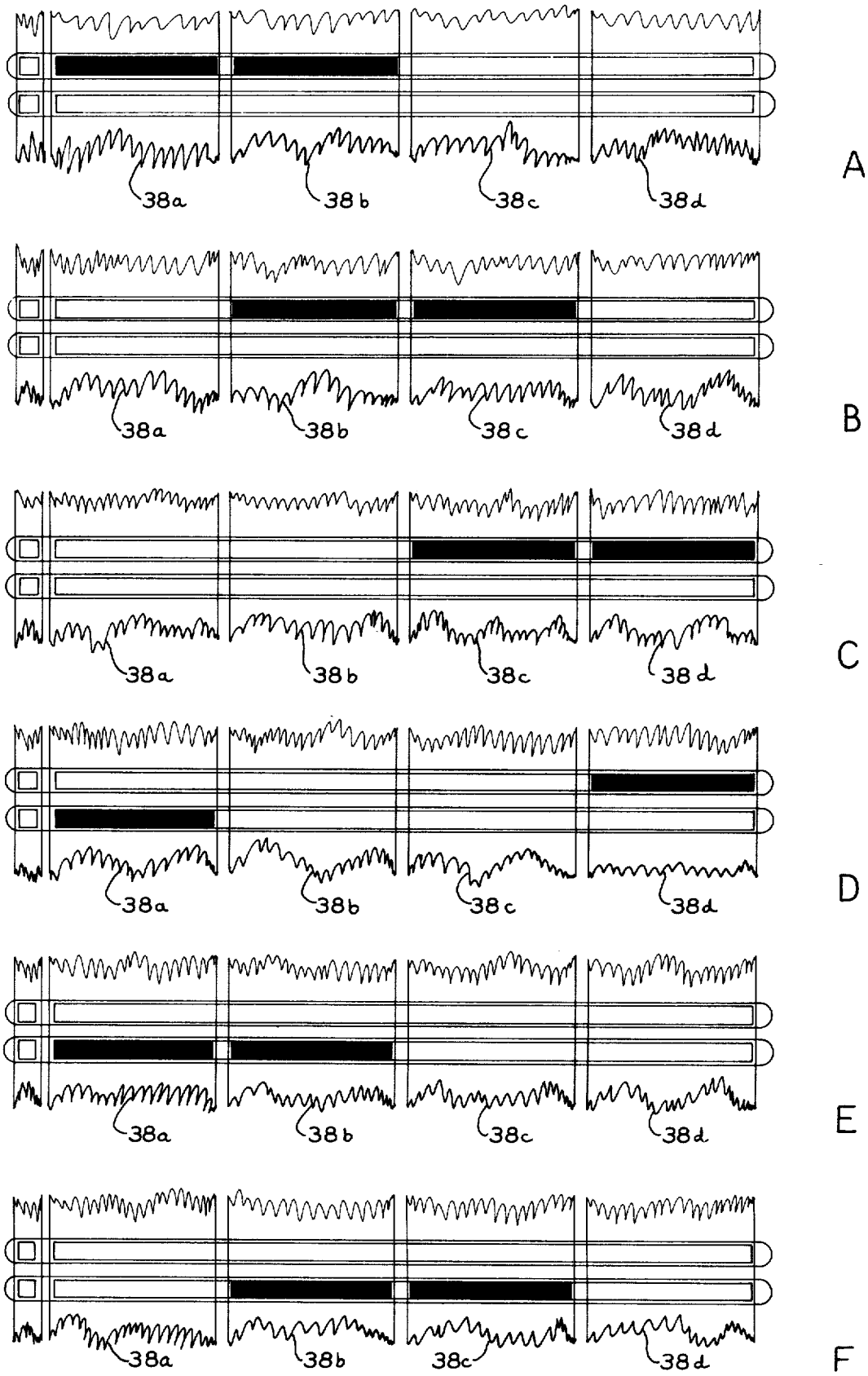

The gas discharge scanner operates in a unique manner by, as shown in FIG. 11, moving progressively across the horizontal row of PC elements in segments progressing as it does from FIG. 11A to FIG. 11B, 11C, 11D and then repeating 11A in 11E but in the second row. Also compare FIG. 11B and FIG. 11F. This condition occurring progressively through all of the rows. If, during such scanning, the given PC elements are electrically addressed in their high-conductance condition by the gray scale address 14 (FIG. 9) it is possible under both these conditions, occurring simultaneously, that the PC element will be energized to the exclusion of all of the other PC elements.

Because scanning by 12 occurs in advance of address, by the gray scale address 14, the response of the photoconductor is very fast when electrically addressed by the gray scale. Thus if the three conditions are met - (1) sufficient illumination while the PC is in an energized level, (2) is electrically addressed by the gray scale address, and (3) anode switch is closed, the PC elements will be energized and uniquely so.

What earmarks the present invention is the unique addressing, pre-conditioning and switching for the PC elements in order to make the pattern effective for rapidly moving displays such as television pictures, and all has been accomplished with a minimum number of conductors, this making the invention adapted for flat image picture tube operation, and is therefore the first of its kind.

Although the present invention has been illustrated and described in accordance with a single example embodiment, it is understood that this is illustrative of the invention and is by no means restrictive thereof. It is reasonably to be expected that those skilled in this art can make numerous revisions and adaptations and it is intended that such revisions and adaptations will be included within the scope of the following claims as equivalents of the invention.

What I claim is:

1. In an optical display device; at least one conductive member having at least one end exposed, light emitting means at said one end of said member responsive to a voltage applied to said member for developing light, a source of chronologically spaced voltage pulses, an impedance element serially connected between said source and said member, the impedance of said element being high when the element is dark and going low after a predetermined time delay when the element is illuminated, and illuminating means for illuminating said element for a period of time prior to the supply of a pulse thereto from said source, said period of time being at least as long as said time delay whereby the supply of a voltage pulse to said element results in substantially instantaneous actuation of said light emitting means.

2. An optical display device according to claim 1 which includes means for varying the voltage of said pulse thereby to control the amount of light produced by said light emitting means.

3. An optical display device according to claim 1 in which said illuminating means includes gas containing means electrically operable into a condition of luminescence.

4. An optical display device according to claim 1 in which said light emitting means includes gas containing means electrically operable into a condition of luminescence.

5. In a display device; at least one row of conductive members supported in spaced electrically insulating relation with at least one and the same end of each member exposed, light emitting means at said one end of each said member responsive to a voltage on said member for developing light adjacent said one end of the member, a plurality of wires, an impedance element connected between each member and a respective wire, each element having a high impedance when dark and going to a low impedance at the end of a predetermined delay after being illuminated, illuminating means for illuminating said elements, means for applying voltage pulses to said wires sequentially, and means for initiating illumination of each said element a period of time in advance of the application of a voltage pulse to the wire connected to the respective element which is not less than said predetermined delay whereby each said light emitting means is actuated substantially simultaneously with the application of a voltage pulse to the wire connected to the element pertaining to the respective member.

6. A display device according to claim 5 which includes means for varying the voltage of respective ones of said pulses thereby to vary the amount of light emitted by respective ones of said light emitting means.

7. A display device according to claim 4 which includes at least one other row of the said members and respective elements, said other row being parallel to said one row and adjacent said one row and having respective illuminating means for illuminating the elements pertaining thereto, the said wires being connected to corresponding elements of each said row, and means for energizing the illuminating means for the elements of said rows sequentially.

8. A display device according to claim 5 in which said one row of members is divided into a series of groups of members, said illuminating means comprising a chamber extending along said row and containing a gas which luminesces in the presence of an electric discharge, a first electrode extending the length of said row on the side of the chamber remote from said row, a second electrode on the side of the chamber nearest said row for each said group of members, means for ionizing the gas in the chamber and for energizing said first electrode, means for supplying voltage pulses to the wires connected to said elements sequentially commencing at one end of said row, and means for energizing said second electrodes sequentially commencing at the same said end of said row, each second electrode being energized the same period of time prior to the supply of a voltage pulse to the one of the elements of the respective group which is nearest said one end of said row.

9. A display device according to claim 7 in which each said row of members is divided into a series of groups of members with the groups of one row registering with the groups of the other row, said illuminating means comprising a chamber extending along each said row and containing a gas which luminesces in the presence of an electric discharge, a first electrode extending the length of each said row on the side of the respective chamber remote from the row, a second electrode on the side of each chamber nearest said rows for each said group of members, said second electrodes being common to the groups in each row, means for ionizing the gas in said chambers sequentially and during each period of ionization energizing the respective said first electrode, means for supplying voltage pulses to the wires connected to said elements sequentially commending at the same end of each said row during each said period of ionization, and means for energizing said second electrodes sequentially during each period of ionization commencing at the same said end of each row, each second electrode being energized the same period of time prior to the supply of a voltage pulse to the one of the elements of the respective group which is nearest said one end of said row.

10. A display device according to claim 8 in which each second electrode is transparent.

11. A display device according to claim 9 in which each second electrode is transparent.

12. A display device according to claim 1 which includes a first panel closing the side of the chamber remote from said row and having said first electrode thereon on the chamber side, a second transparent panel closing the side of the chamber adjacent said row, each said element being mounted on the respective member adjacent said transparent panel, and each said second electrode comprising a transparent electrically conductive film on the chamber side of said second panel.

13. A display device according to claim 8 which includes a first panel closing the sides of the chambers remote from said rows and having said first electrodes thereon on the chamber side facing the said chambers, a second transparent panel closing the sides of the chambers adjacent said rows, each said element being mounted on the respective member adjacent said transparent panel, and each said second electrode comprising a transparent electrically conductive film on the chamber side of said second panel, each second electrode being common to a respective group of members of each said row.

14. A display device according to claim 5 which includes a plurality of parallel and adjacent rows of said members and respective elements, said elements being mounted on the ends of said members opposite the said one end thereof, a transparent panel overlying said elements, a body engaging the side of the panel facing away from the elements and having a chamber extending therethrough registering with each row of elements, a closure plate engaging the side of said body opposite said panel, a gas in said chambers which luminesces in the presence of an electric discharge, a first electrode on said plate in each chamber substantially coextensive with the respective row of elements, transparent second electrodes on the chamber side of said panel extending over all of said chambers at right angles to said first electrodes and insulated from each other, each second electrode registering with a group of a predetermined number of said elements in each row thereof, first and second electrode elements in each chamber operable to ionize the gas in the respective chamber when energized, each said wire being connected to the corresponding element in each row, means for energizing said first and second electrode means for said chambers in succession proceeding in one direction to ionize the gas therein, means for energizing said first electrodes for each group of chambers in succession proceeding in the said one direction and during the interval that gas in the respective chambers is ionized, means for engaging said second electrodes in succession proceeding in a second direction perpendicular to said one direction and during the interval of energization of each first electrode, the period of energization of each second electrode overlapping the periods of energization of the second electrodes next adjacent thereto on each side, and means for addressing said wires in succession proceeding in said second direction with the wires pertaining to each group of elements being addressed during the final portion only of the period of energization of the respective second electrode.

15. A display device according to claim 14 which includes n sources for energizing said first electrodes and every nth first electrode is connected to a respective one of said n sources, and an independent source for energizing the said first and second electrode means for each said chamber.

16. A display device according to claim 3 in which said light emitting means comprises a transparent panel in spaced parallel relation to said one ends of said members, transparent electrode means on the side of the panel facing said elements, and a gas in the space between said panel and said members which luminesces in the presence of an electric discharge.

17. A display device according to claim 16 in which said transparent electrode means comprises a plurality of electrodes parallel to said second electrodes and adapted for energization sequentially.

18. A display device according to claim 16 in which said one end of each member is concave toward said panel.

19. A display device according to claim 16 which includes means for varying the voltage between said members and said transparent electrode means thereby to vary the light developed at said one end of respective ones of said members.

20. A display device according to claim 14 which includes a panel of electrical insulating material supporting said members, said light emitting means comprising a further transparent panel parallel to and spaced from said one ends of said members and having transparent electrode means on the side facing said members, a gas in the space between said further panel and said members which luminesces in the presence of an electric discharge, and means sealing said panels together about the periphery thereof.

21. A display device according to claim 20 which includes means for varying the voltage between said transparent electrode means and said members when pulses are supplied to the members thereby to vary the amount of light created at said one end of respective ones of said members.

22. A display device according to claim 17 which includes means for receiving a television video signal and for detecting the sync signal therein, a clock, a first counter operating by said clock and having outputs connected to said wires and connected to be set to zero count on each sync signal, a monostable vibrator actuated by said clock and having outputs connected to said first electrode means, a second counter actuated by said clock and having outputs connected to said second electrode means, a third counter actuated by said clock, a first read only memory having inputs connected to the outputs of said third counter and outputs connected to said second electrode, said third counter being connected to be set to zero on each sync signal, a fourth counter actuated by said clock and a second read only memory having inputs connected to the outputs of said fourth counter and outputs connected to said transparent electrode means, a fifth counter actuated by said first counter and a third read only memory having an input connected to the output side of said fifth counter and outputs connected to said first electrodes.

23. The method of controlling the supply of control pulses from a signal source to a signal receiver in which a radiation sensitive impedance element is serially connected between the source and the receiver, said impedance element going to a high impedance when the radiation thereto is interrupted and going to a low impedance after a predetermined delay when radiation is supplied thereto, said method comprising; placing a source of radiation adjacent said element, interrupting the supply of radiation to the impedance element to block the flow of signals from the source to the receiver, supplying radiation to the impedance element to permit the flow of signals from the source to the receiver, and establishing the said supply of radiation to said element a predetermined period of time before the supply of a control pulse from said signal source and which period of time is at least as great as said predetermined delay.

24. The method according to claim 23 in which said radiation is light, said source of radiation is an electrically operable light source, and the control of the light supplied to said element is controlled by controlling the energization of said light source.

25. In a signal transmitting device; a conductive member having an electric signal emitting region and an electric signal receiving region, a source of electric signals, a radiation sensitive impedance element connecting said source to said signal receiving region and having a predetermined time constant representing the time required for the element to go to a condition of high conductivity in the presence of radiation, means for supplying chronologically spaced signals from said source to said element with each signal having a duration substantially less than the same time constant of said element, and means for intermittently supplying radiation to said element in such timed relation to the supply of said signals thereto that the element is in a condition of high conductivity when each said signal is supplied thereto.

26. The method of transmitting electric signals under the control of a radiation sensitive impedance element in which the time period of a said signal is substantially less than the time period required for the element to go to low impedance in the presence of radiation, said method comprising effecting the intermittent and repetitive supply of radiation to said element and the intermittent and repetitive supply of electric signals to said element in such timed relation that the element has low impedance when a said signal is supplied thereto.

27. The method according to claim 26 which includes supplying said signals to the element at a rate which is a multiple of the rate at which radiation is supplied to the element whereby the rate of signal transmission via said element is controlled by the rate at which radiation is supplied thereto.

28. The method of producing a display comprising the steps of optically scanning in groups a plurality of photoconductor elements arranged in a series of rows to produce pre-energization of such photoconductor elements, electrically addressing selected ones of the pre-energized photoconductor elements through a gray scale address system, and repeating the optical scanning and addressing through the entirety of the array of photoconductor elements to produce a display by those discharging photoconductor elements which are electrically addressed in their pre-energized condition.

29. The method of producing a display comprising the steps of optically scanning a plurality of photoconductor elements to produce the pre-energization thereof, superimposing in delayed sequence an electrical signal to pre-selected ones of said pre-energized photoconductor elements through a gray scale address, with a pre-select display anode to effect discharge of a particular photoconductor element.

30. The method of producing an intelligible light display through a coordinated system of the multiple layer matrix systems having the relationship of:

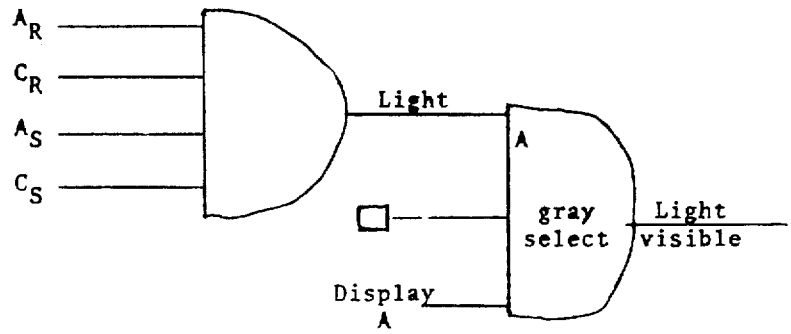

and wherein:

$A_R$ = reset anode
$C_R$ = reset cathode
$A_S$ = scan anode
$C_S$ = scan cathode
□ = gray scale address
$D_A$ = display anode
A - light.

* * * * *